US005301476A

United States Patent [19]

Wu

[11] Patent Number: 5,301,476

[45] Date of Patent: Apr. 12, 1994

[54] MOBILE STAGE

[76] Inventor: Wen-Chong Wu, 4F, No. 37, lane 111, Kang Le St., Nei Hu Dist., Taipei, Taiwan

[21] Appl. No.: 3,564

[22] Filed: Jan. 13, 1993

[51] Int. Cl.[5] ..... E04H 3/10

[52] U.S. Cl. ..... 52/6; 52/79.5

[58] Field of Search ..... 52/6, 7, 79.5

[56] References Cited

U.S. PATENT DOCUMENTS 4,078,442 1/1992 Rau et al. ..... 52/7 X 5,018,322 5/1991 Fujita ..... 52/7

5,069,006 12/1991 Fujita ..... 52/7

5,152,109 10/1992 Boers ..... 52/6 X

*Primary Examiner*—Philip C. Kannan

*Attorney, Agent, or Firm*—Bacon & Thomas

[57] ABSTRACT

Disclosed is a mobile stage including a forestage with concealed footlights, a roof connected to the forestage by a telescopic frame assembly, a sky drop mounted on the telescopic frame assembly and disposed between the roof and the forestage, a visual display terminal mounted on the forestage at the front, stage ighting fixtures mounted on the roof and the sky drop, and a distributing box mounted on the forestage at the back for power supply control.

5 Claims, 4 Drawing Sheets

MOBILE STAGE

BACKGROUND OF THE INVENTION

The present invention relates to a stage, and relates more particularly to a mobile stage which can be conveniently dismantled for moving from place to place and then re-assembled at a desired location.

In a restaurant, night club, or entertainment center, there may be provided a small stage for people to perform different plays. Stage lighting fixtures and other audio and video equipment may also be installed in the stage to produce sound and lighting effects. A stage of this type is specifically designed and then constructed at the selected location. Therefore, a stage of this type is not detachable and can not be moved once it was constructed. Because it is specifically designed, its construction cost is expensive. Further, a stage of this type is difficult to maintain, and it requires much time to construct. When various electrical devices are to be installed, the electric wiring is also difficult to arrange.

SUMMARY OF THE INVENTION

The present invention eliminates the aforesaid disadvantages. It is therefore an object of the present invention to provide a mobile stage which can be dismantled and then re-assembled at a different location. Another object of the present invention is to provide a mobile stage which is inexpensive to manufacture and easy to maintain. Still another object of the present invention is to provide a mobile stage which has a distribution box for safety power supply control.

According to the preferred embodiment of the present invention, the mobile stage comprises a forestage having concealed footlights and a mounting socket for mounting a visual display terminal, a roof connected to the forestage by a telescopic frame assembly, which is consisted of channel bars and hollow square columns, a sky drop mounted on the telescopic frame assembly and disposed between the roof and the forestage, a visual display terminal mounted on the forestage at the front, stage lighting fixtures mounted on the roof and the sky drop, and a distributing box mounted on the forestage at the back for power supply control.

DETAILED DESCRIPTION OF THE PREFERRED EMBODIMENT

Figure 1:
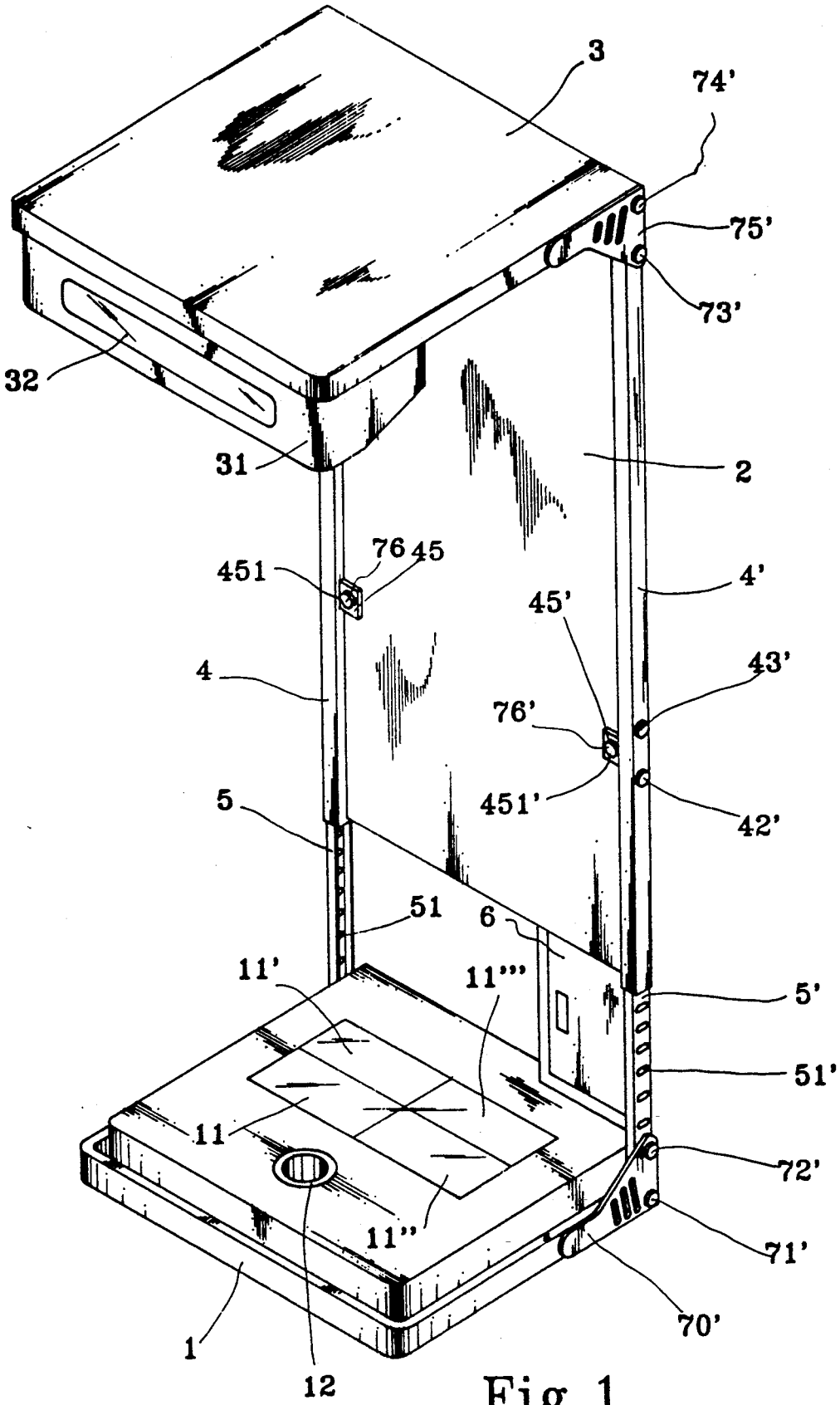
FIG. 1 is an elevational view of a mobile stage embodying the present invention.

Referring to FIG. 1, a mobile stage in accordance with the present invention is generally comprised of a forestage 1, a sky drop 2, a roof 3, two hollow, square columns 4,4', two channel bars 5,5', and a distributing box 6.

Figure 2:
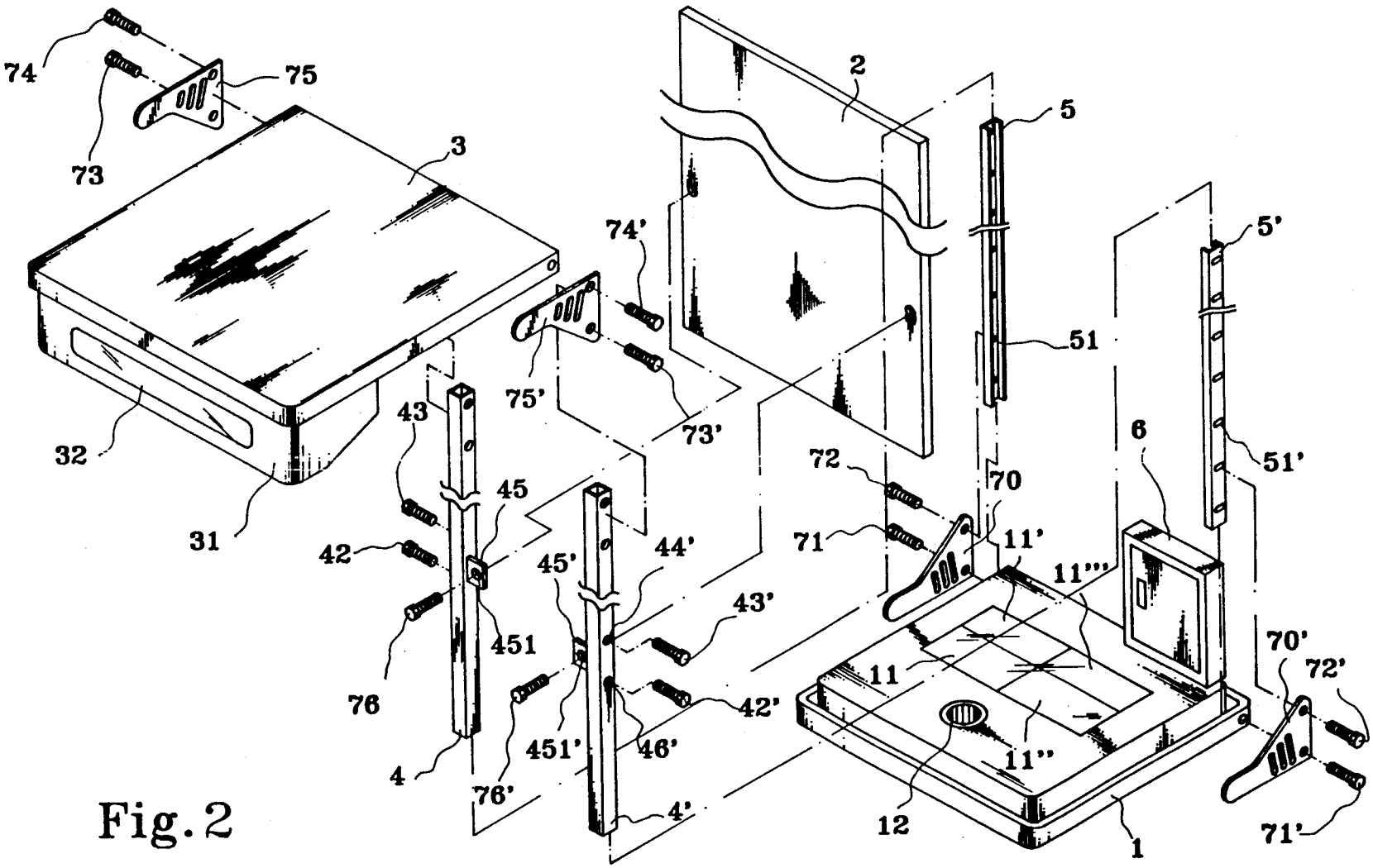
FIG. 2 is an exploded view thereof.
Figure 4:
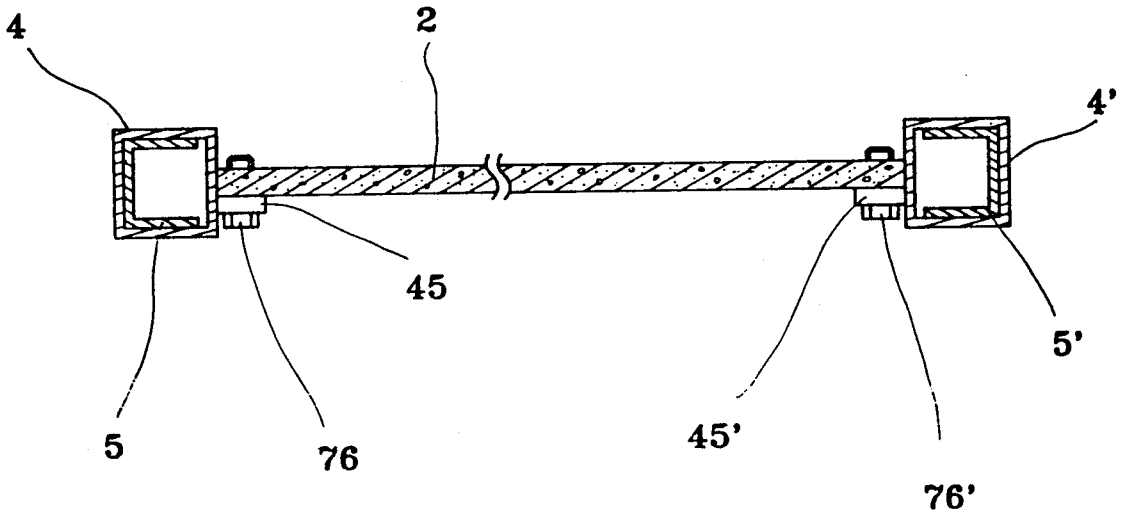
FIG. 4 is a cross section taken along a transverse line through the tabs on the hollow, square columns.

Referring to FIGS. 2 and 4 and FIG. 1 again, forestage 1 comprises concealed footlights 11,11',11'',11''' in different colors, and a mounting socket 12 in front of the concealed footlights for mounting a visual display terminal. Two channel bars 5,5' are bilaterally and vertically fastened to the forestage 1 at the back by packing plates 70,70' and screws 71,71',72,72'. Two hollow, square columns 4,4' are respectively sleeved on the channel bars 5,5'. The columns 4,4' can be moved on the channel bars 5,5' in vertical direction and then locked at a desired elevation. A roof 3 is fastened to the columns 4,4' at the top by packing plates 75,75' and screws 73,73',74,74' and disposed in parallel with the forestage 1. The roof 3 comprises a show case 31 with a replaceable display card 32 at the front. The channel bars 5,5' have series of longitudinally spaced locating slots 51,51' for locking the columns 4,4' at any of various elevations. The columns 4,4' comprise screw holes 44,44',46,46', through which lock bolts 42,42',43,43' are respectively inserted into locating slots 51,51' on the channel bars 5,5' to lock the columns 4,4' at a desired elevation, and mounting tabs 45,45' with screw holes 451,451'. A sky drop 2 is fastened to the mounting tabs 45,45' by screws 76,76', and disposed between the columns 4,4' within the forestage 1 and the roof 3. A distributing box 6 is fastened to the forestage 1 at the back and controlled to provide electricity to the concealed footlights 11,11',11'',11''' and other external lighting fixtures, or audio and video equipment.

Figure 3:
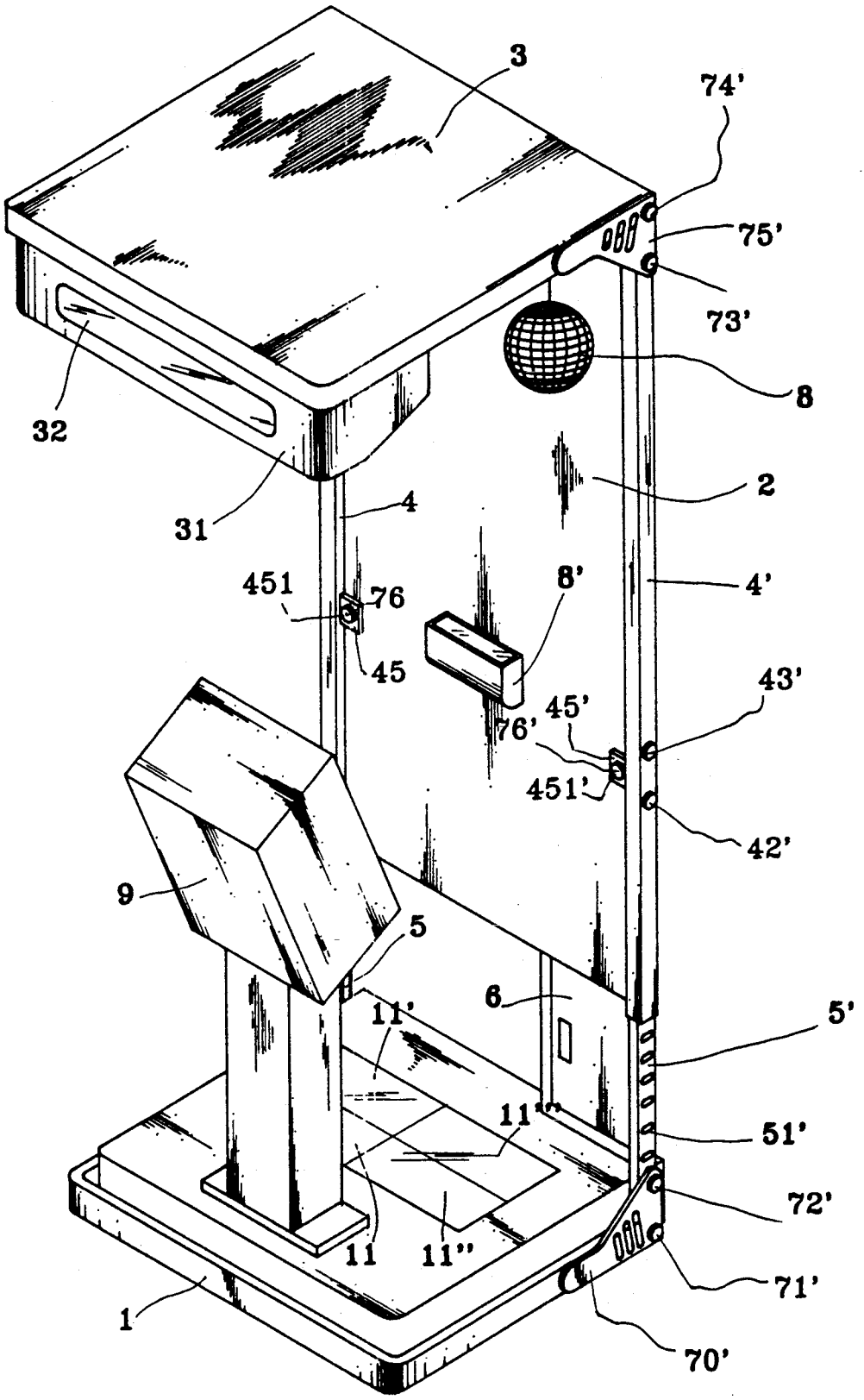
FIG. 3 is an applied view showing a visual display terminal mounted on the forestage, and different stage lighting fixtures mounted on the roof and the sky drop.

Referring to FIG. 3, rotary lamps 8 and cyclorama floodlights 8' may be mounted on the roof 3 or the sky drop 2, and a visual display terminal 9 of a video tape player or video disc player may be mounted on the mounting socket 12 on the forestage 1. Therefore, a person can stand on the forestage 1 to play a show under variable sound and lighting effects.

I claim:

1. A mobile stage comprising:

a forestage having a plurality of concealed footlights, and a mounting socket in front of said concealed footlights for mounting a visual display terminal;

two channel bars detachably and bilaterally fastened to said forestage at the back in vertical direction, each channel bar having a series of vertically spaced locating slots;

two hollow, square columns respectively sleeved on said channel bars, each column having two vertically spaced screw holes, through which two locating bolts are respectively inserted into respective locating slots on either channel bar in locking the respective column at a desired elevation;

a roof detachably fastened to said columns at the top and disposed in parallel with said forestage;

a sky drop detachably mounted on said hollow, square columns between said roof and said forestage; and a distributing box for power supply.

2. The mobile stage of claim 1 wherein said forestage and said roof are respectively fastened to said channel bars and said hollow, square columns by packing plates and screws.

3. The mobile stage of claim 2 wherein said packing plates are respectively made in a triangular shape, each having at least two bolt holes.

4. The mobile stage of claim 1 which further comprises a visual display terminal mounted on said mounting socket of said forestage, and stage lighting fixtures respectively mounted on said roof and said sky drop.

5. The mobile stage of claim 1 wherein said roof comprises a show box having a replaceable display card.

* * * * *